US009380925B2

(12) United States Patent
Eichholz et al.

(10) Patent No.: US 9,380,925 B2
(45) Date of Patent: Jul. 5, 2016

(54) HOUSEHOLD APPLIANCE WITH A DRYING SYSTEM FOR WET ARTICLES

(75) Inventors: Heinz-Dieter Eichholz, Iserlohn (DE); Bernd Geser, Waeserburg (DE)

(73) Assignee: SANHUA AWECO APPLIANCE SYSTEMS GMBH, Neukirch (DE)

( * ) Notice: Subject to any disclaimer, the term of this patent is extended or adjusted under 35 U.S.C. 154(b) by 673 days.

(21) Appl. No.: 13/573,105

(22) Filed: Aug. 22, 2012

(65) Prior Publication Data

US 2013/0055581 A1 Mar. 7, 2013

(30) Foreign Application Priority Data

Aug. 22, 2011 (DE) ..... 10 2011 110 792
Nov. 7, 2011 (DE) ..... 10 2011 117 734

(51) Int. Cl.
*F26B 25/06* (2006.01)
*A47L 15/48* (2006.01)
*D06F 58/24* (2006.01)

(52) U.S. Cl.
CPC ..... *A47L 15/481* (2013.01); *A47L 15/486* (2013.01); *D06F 58/24* (2013.01)

(58) Field of Classification Search
CPC ..... A47L 15/481; A47L 15/486; D06F 58/24
USPC ..... 34/597
See application file for complete search history.

(56) References Cited

U.S. PATENT DOCUMENTS

2005/0150529 A1 7/2005 Vanderroest et al.
2007/0227030 A1 * 10/2007 Oh et al. ..... 34/60
2010/0116296 A1 5/2010 Bertsch

FOREIGN PATENT DOCUMENTS

DE 10 2004 040 423 A1 2/2006
DE 10 2010 047 058 A1 4/2011
DE 10 2010 047058 A1 4/2011
WO WO 2005/053503 A1 6/2005
WO WO 2011/076650 A1 6/2011

OTHER PUBLICATIONS

English translation of DE 102010047058 A1, Anmelder, Apr. 14, 2011.*

* cited by examiner

*Primary Examiner* — Jiping Lu
(74) *Attorney, Agent, or Firm* — Breneman & Georges

(57) ABSTRACT

Provided is a household appliance, in particular dishwasher, tumble drier or the like, having a primary circuit which has a hygroscopic liquid, in particular brine solution, for extracting moisture from drying air, and a secondary circuit for drying wet articles by drying air, wherein a contact chamber is provided which has at least one dispersal element for surface area enlargement of the contact surface of the hygroscopic liquid for the drying air, characterized in that the dispersal element of the contact chamber has at least one drive for imparting drive and/or movement, such that for the surface area enlargement, the hygroscopic liquid can be dispersed with kinetic drive energy.

13 Claims, 4 Drawing Sheets

SECTION A-A

HOUSEHOLD APPLIANCE WITH A DRYING SYSTEM FOR WET ARTICLES

CROSS REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON COMPACT DISC, OR AS TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION (1) Field of the Invention

The invention relates to a household appliance according to the preamble of claim 1.

(2) Description of Related Art Including Information Disclosed Under 37 C.F.R. 1.97 and 1.98

Dishwashers with drying air circuits are known in the prior art for example from WO 2005/053503 A1. Into said drying air circuits there is incorporated a closed system composed of an ice water vessel and of a storage vessel which is connected to the ice water vessel via a line and which contains zeolite. Here, the drying air is dehumidified by condensation on the outer wall of the ice water vessel and is heated on the outer wall of the storage vessel by means of zeolite.

Household appliances are also known, from DE 10 2010 047 058 A1, which have a drying system for wet articles, having a primary circuit for extracting moisture from drying air and having a secondary circuit for drying wet articles by means of drying air. The circuits contain, on the one hand, a single-phase liquid circuit, composed of at least 2 components, of a liquid refrigerant and fully dissolved solid matter, generally fully dissociating salts, the primary circuit, and on the other hand, a substantially single-phase gas/vapor circuit, the secondary circuit. The operating direction of the primary and secondary circuits, as a function of the selected process temperatures and media states, constitutes in each case one section of a thermodynamic two-substance absorption circuit which is operated in a divided manner. One operating direction realizes the absorption phase of the cycle, the other operating direction describes the desorption or expulsion phase of the cycle. In the absorption phase, the two-component solution is enriched with the component which functions as refrigerant, and in the desorption or expulsion phase, the two-component solution which is present is freed from parts of the refrigerant valve.

The two circuits, the primary and the secondary circuit, comprise a dedicated on-site actuator by means of which the mass conversions in the circuits are maintained and assisted in a common reaction chamber for performing the extraction of moisture by hygroscopic action of the extraction medium. Said reaction chamber constitutes the residence and mass transfer zone of the gas/vapor flow of the secondary circuit and of the single-phase flow of the primary circuit for the thermodynamic drying circuit, and determines, by its absorption efficiency, the efficiency of the drying action. The provision of an adequately large reaction surface for the no longer positively guided single-phase flow in the area of reaction with the gas/vapor flow thus takes up a large structural space and entails cumbersome and expensive structural measures to ensure that, in any orientation of the household appliance, even when not in operation during shipping and transportation, the liquid phase is contained exclusively in the primary circuit.

Furthermore, DE 10 2010 047 058 A1 discloses a household appliance, wherein for improved thermal and/or energy management the primary circuit comprises a hygroscopic extraction medium for the exothermic extraction of the moisture from the drying air, and wherein the heating device in the secondary circuit is designed to heat the drying air by means of the thermal energy released during the exothermic extraction of the moisture.

BRIEF SUMMARY OF THE INVENTION

Disadvantages of the prior art are however the relatively high outlay in terms of construction and energy and thus also the financial expenditure for producing and operating such household appliances.

It is an object of the present invention to propose a household appliance with a drying system which reduces the outlay in terms of construction and/or energy and thus also the financial expenditure for producing and/or for operating such household appliances.

The object is achieved, taking as a starting point a household appliance according to the preamble of claim 1, by means of the characterizing features of claims 1 and/or 2 and/or 3. Advantageous embodiments and refinements of the invention are possible by means of the measures specified in the dependent claims.

Accordingly, the dispersal element of the contact chamber has at least one drive for imparting drive and/or movement, such that for the surface area enlargement, the hygroscopic liquid can be dispersed with kinetic drive energy. As an alternative to or in combination with this, according to the invention, the dispersal element is movable in the contact chamber and has at least one drive, such that a surface area enlargement of the hygroscopic liquid is provided by means of the transfer of kinetic drive energy by the movement of the dispersal element. Likewise as an alternative to or in combination with this, according to the invention, the dispersal element of the contact chamber is in the form of a dispersal nozzle and has at least one drive for driving and/or pressurizing the hygroscopic liquid, such that for surface area enlargement, the hygroscopic liquid can be dispersed with kinetic drive energy.

The common concept according to the invention is that of the hygroscopic liquid not flowing down passively or under the force of gravity, as in the prior art, but rather advantageously being actively acted on with kinetic energy such that it is dispersed or atomized/nebulized as advantageously as possible. That is to say, according to the invention, the greatest possible number of droplets, which are as small as possible, is generated so as to generate a particularly large overall contact surface of the hygroscopic liquid. Said relatively large contact surface of the hygroscopic liquid with the drying air to be dried permits particularly effective and also efficient drying. Above all, it is possible according to the invention to realize good drying results in a relatively short time, such that the convenience for the user of the household appliance is very high, and such that the drying can advantageously be integrated effectively into the program cycles of the household appliance.

It has furthermore been found, in initial tests, that the energy efficiency of the invention is particularly high in relation to the prior art.

It is basically possible for a separate drive to be provided for the dispersal element. In one particular refinement of the invention, a drive which is already provided for other purposes or functions within the household appliance is additionally used for driving the dispersal element.

It is particularly advantageous for the fan motor of the secondary circuit to be used as a drive of the dispersal element. With this advantageous double utilization of the fan motor or fan, it is possible for the outlay both in terms of construction and also in terms of control and also the costs for production and operation to be reduced.

It is advantageously provided that the contact chamber is in the form of an interior space of a fan housing of the fan, and/or that the dispersal element is in the form of a fan impeller of the fan. It is achieved in this way that not only the fan motor but also the main parts/components of the fan which is already provided are used for multiple purposes. This additionally reduces the outlay for the realization of the invention.

Furthermore, as a result of the additional or implemented double utilization of the fan wheel and/or of at least a part of the interior space of the fan housing, it is achieved that particularly advantageous swirling and mixing of the hygroscopic liquid with the drying air to be dried are realized. As a result of relatively high rotational speeds of the fan impeller/blade, intense turbulence and high accelerations of the hygroscopic liquid are attained. The hygroscopic liquid is dispersed into a multitude of relatively small droplets and centrifuged through and/or into the drying air. As a result of an impingement of the hygroscopic liquid against walls or components of the fan housing or against advantageous separation elements, it is possible for the hygroscopic liquid to furthermore be atomized/dispersed and for the contact surface to be correspondingly enlarged. Hygroscopic liquid running down on walls or components of the fan housing or on the separation elements also increases the contact surface of the hygroscopic liquid with the drying air, which has a positive effect on the drying action and the efficiency.

The drive is preferably in the form of a pump motor of a pump, in particular of a rotary pump, for pumping the hygroscopic liquid of the primary circuit. Said additional utilization or triple utilization of the drive of the dispersal element additionally reduces the outlay in terms of construction and control and also the financial expenditure.

The drive of the dispersal element is for example formed as a fan motor and furthermore as a pump motor. Accordingly, said common drive has not only the fan wheel but rather also a pump wheel for pumping the hygroscopic liquid. The fan impeller is furthermore in the form of a dispersal element according to the invention. In this way, not only is an advantageous multiple utilization of the relatively expensive (electric) motor realized, but rather a particularly high integration density of the components is also attained. This also leads to a particularly space-saving or compact design, such that the integration of the drying system into a household appliance is possible in a particularly effective manner.

In one advantageous variant of the invention, the pump comprises at least one hollow truncated cone, which widens in the direction of the dispersal element, as pump impeller and/or feed element for feeding the hygroscopic liquid to the dispersal element. Here, the hollow truncated cone forms the rotor or pump impeller of the pump. As a result of the conical form of the rotor which widens in the direction of the dispersal element/fan impeller, it is achieved that the hygroscopic liquid is delivered or moves along the wall under centrifugal force not only outward but rather also in the axial direction and/or upward. Here, the hygroscopic liquid may be transported or delivered axially both on the outer wall and also on the inner wall of the rotor or hollow truncated cone. The pump preferably sucks the hygroscopic liquid out of a reservoir and forces it toward the dispersal element or fan impeller.

For an improved pumping action, it is advantageous for rotor blades or fins or the like to be provided which are arranged at least partially in the radial direction. The rotary drive of the hygroscopic liquid, which is stored in particular in a reservoir, is improved in this way, such that higher centrifugal or pumping forces are realized. The pumping action is hereby improved.

The fan impeller including fan blades is preferably formed as a single-piece structural unit together with the pump impeller including pump impeller blades/fins. This may be produced for example from plastic in a relatively effective and expedient manner for example by means of injection molding.

In one advantageous embodiment, at least one separation unit for separating the hygroscopic liquid from the drying air is arranged downstream of the dispersal element in the flow direction of the drying air. The fan housing preferably at least partially encompasses the separation unit. At least a part of the walls of the fan housing is for example formed as a separation unit or separation element. Separate or further separation elements are provided if appropriate. These may advantageously be adapted for the separation of the hygroscopic liquid from the drying air. A surface area enlargement of the separation unit is for example provided, such that the dispersed or atomized hygroscopic liquid can adhere thereto and is separated from the drying air.

The separation unit advantageously comprises at least one annular or spiral duct. Said duct is preferably integrated in the fan housing and/or forms the pressure side of a rotary and/or radial fan.

If appropriate, a separation device may be provided which is separate from and/or additional to the fan. Said separation device may for example comprise a labyrinth seal or the like. Particularly efficient division or separation of the hygroscopic liquid from the drying air can be realized by means of the separation device. It is hereby achieved that as little hygroscopic liquid as possible or no hygroscopic liquid passes into the region of the articles, such as crockery or laundry, to be dried, which would lead to an escape of the hygroscopic liquid from the household appliance. If an escape of the hygroscopic liquid from the household appliance were to occur, said hygroscopic liquid would have to be correspondingly replenished or compensated again.

A reservoir of the hygroscopic liquid preferably comprises a heating unit for heating the hygroscopic liquid. A concentration or regeneration of the hygroscopic liquid after the absorption of water from the drying air to be dried is thus realized. It would also by all means be possible to provide some other regeneration of the hygroscopic liquid, such as for example by means of a centrifuge and/or a semipermeable membrane for separating off the absorbed water.

The household appliances in question may basically be inter alia dishwashers, tumble dryers or for example also combined washing and drying machines, so-called washer-dryers, or fully automatic washing machines. Consideration may however also be given to other household appliances which can implement such drying processes. In the case of washer-dryers or combined washing and drying machines, the wet articles are generally items of laundry or clothing, and in the case of dishwashers, the wet articles are correspondingly generally plates, pots, pans, cutlery or other crockery. A use in beverage machines is also conceivable.

Drying air within the meaning of the invention is a gas, in particular air, which is utilized for drying the wet articles and which accordingly absorbs moisture during the drying process. The drying air is thus generally relatively dry before the drying process, and relatively moist thereafter.

The extraction medium or the hygroscopic liquid within the context of the invention serves for extracting moisture from the drying air and thus dries the drying air.

The primary circuit is advantageously designed for extracting moisture from drying air. The drying air itself advantageously circulates in a secondary circuit. Preferably wet articles in the household appliance are dried by means of the drying air. In the case of a dishwasher, the wet articles are for example crockery to be cleaned in the dishwasher, which crockery, after the end of the cleaning program, is dried according to the invention in order that the user can remove dry crockery from the household appliance and either immediately use it or store it for example in a cupboard. Here, the drying air is for example conducted or actively blown to the wet articles, absorbs the moisture from said articles there, and can/should subsequently be regenerated to a certain extent such that it can be used again for drying.

For the regeneration of the drying air, the moisture is for example extracted therefrom. Furthermore, the drying air may also (subsequently) be heated again, because heated air can generally absorb more moisture. Said heating step may for example take place before the drying air is blown to the corresponding wet articles by means of the fan. For this purpose, the secondary circuit comprises a heating device for heating the drying air.

In the primary circuit, a hygroscopic extraction medium or the hygroscopic liquid is stored in a reservoir. A substance is hygroscopic if it can absorb moisture from the environment, for example from the air surrounding it. Said extraction of the moisture from the environment may be an exothermic process, that is to say one in which thermal energy is released. In thermodynamics, exothermic processes are processes in which there is a negative (by definition) reaction enthalpy of reaction $\Delta H=\Delta U+W<0$, wherein $\Delta H$ is the enthalpy of reaction, $\Delta U$ is the internal energy stored in the corresponding participating substances and W is the work done during the process. Here, according to the invention, the drying air must come into direct contact with the hygroscopic extraction medium.

A particular advantage of the household appliance according to the invention is that the thermal energy released during the exothermic extraction of the moisture is put to further use, thus permitting greater heat utilization. The heating device for heating the drying air is designed to utilize said released heat.

In order that the drying air can come into direct contact with the extraction medium, it may be advantageous for the primary and secondary circuits to have a common flow section, that is to say to be directly coupled to one another.

Various substances may be taken into consideration as extraction medium. In particular, for exemplary embodiments of the invention, consideration is given to a range of electrolyte solutions, that is to say generally solutions which have hygroscopic properties, with dissociated ions, for example a salt. Among others, an aqueous lithium chloride solution, for example, may be used as extraction medium.

It is however basically also conceivable for other aqueous solutions, in particular aqueous salt solutions, to be used. Another possibility consists for example in using an alcohol solution, in particular a methanol solution. The selection of the extraction medium may for example be dependent on parameters of the household appliance and/or on what demands are to be placed on the corresponding drying process. For example, the selection of the boiling point of the solution, the intensity of the hygroscopicity, the question of whether the extraction medium is admissible for the corresponding application for example from a health aspect, etc., could be of relevance in this regard.

If the extraction medium has come into contact with moist drying air, that is to say if moisture has correspondingly been transferred from the drying agent to the extraction medium, said extraction medium may also advantageously be re-concentrated in order that it can continue to be used for removal of moisture from the drying air. The primary circuit may thus comprise a device for increasing the concentration of the extraction medium or of the hygroscopic liquid.

Said device for increasing the concentration of the extraction medium may for example be in the form of a heater. As a result of the corresponding heating, liquid originating inter alia from the wet articles can then be evaporated from the extraction medium, as a result of which the concentration of the extraction medium can be increased again. It is basically possible for this purpose to use a dedicated heating device within the household appliance.

It is however furthermore possible to utilize the fact that other components in the household appliance already become warm or must be warmed in any case. For example, the device for increasing the concentration of the extraction medium may advantageously be coupled to the heating device of the household appliance. This may have the advantage that otherwise unutilized waste heat is utilized here for the functioning of the household appliance, and thus has a positive effect on efficiency and on heat utilization in particular with regard to the household appliance as a whole.

It is basically also possible to utilize the device for increasing the concentration to dissipate heat from other components, and thus to a certain extent provide cooling for said components. It is thus advantageously possible, if appropriate, to dispense with hitherto conventional heating and/or cooling devices.

It is furthermore conceivable for other devices or methods to also be used in accordance with the invention, in particular for increasing the concentration of the extraction medium, such as for example centrifuges, evaporation with negative pressure, etc.

In the case of intense concentration of the electrolyte solution or of the hygroscopic liquid, it is then possible if appropriate to realize a formation of salt crystals. This may for example be utilized for an advantageous latent heat accumulator, which likewise serves to realize increased heat utilization.

Greater heat utilization and/or improved efficiency can not only contribute to a household appliance and/or a drying process according to the invention and/or embodiments and refinements thereof being made more environmentally friendly and more ecological, but rather can also contribute to a cost reduction during operation of the machine.

If liquid has advantageously been evaporated out of the extraction medium inter alia by means of the heating device, said evaporated liquid can be placed or conducted into an advantageous condensation unit and condensed there. The liquid may then for example be collected or if appropriate conducted directly to the outlet from the household appliance. A decrease in the concentration of the extraction medium can thus be prevented.

Condensation heat is basically released during the condensation process. Said condensation heat, too, may be advantageously utilized within the operation of the household appliance. It is for example possible for corresponding heat exchangers or the like to be provided for this purpose. For example, said heat may be utilized in conjunction with a liquor and/or crockery heating device. In this way, too, it is possible to realize increased heat utilization and improved efficiency of the appliance.

In one advantageous refinement of the invention, the absorption capability of the extraction medium may be increased for example by virtue of its surface area being increased or enlarged, and thus also a larger reaction surface being provided. In the case of a liquid extraction medium, the primary circuit may have provided therein for example a trickling device, a nebulizing unit or the like out of which the extraction medium can trickle, for example in the direction of gravitational force, or nebulized.

It is basically also conceivable, for example, for the extraction medium to be sprayed out of an (atomizer) nozzle, similar to a fountain or the like, by means of the drive according to the invention in order thereby to provide a larger surface area. The nozzle, too, may be designed such that it can be moved by means of the drive according to the invention in order to realize improved dispersal in the contact chamber. The effectiveness of the moisture extraction can thus be increased further.

In order that the drying air in the secondary circuit can circulate in an advantageous manner, in one particular refinement of the invention, a fan or the like may be provided. In this way, the drying process of the wet articles can be accelerated further. In order that the liquid extraction medium in the primary circuit can circulate in an advantageous manner, a pump, for example a rotary pump, may be provided here. Pumps of advantageous size/power are already commercially available and may generally be purchased and installed without excessively high expenditure.

The wet articles in the household appliance are generally accommodated in a working or loading chamber, for example in a working chamber with corresponding crockery baskets in the case of a dishwasher, and generally in a corresponding storage drum in a washing and drying machine. In order that the wet articles can be dried in an advantageous manner, the working chamber may be integrated within the secondary circuit, and advantageously traversed by the flow of drying air.

The drying air which is laden with moisture may subsequently, after drying the wet articles, be sucked out again, for example by means of the fan, owing to the secondary circuit, such that said drying air does not, in a reverse process, wet the crockery again. The moist drying air is thereafter advantageously regenerated as described above and passes for example back into the working chamber, where it can dry the already partially dried articles yet further, etc. The moist drying air may also if appropriate be conveyed out of the household appliance rather than back into the working chamber.

In order that the drying air in the secondary circuit can absorb yet more moisture, it is advantageous for said drying agent to undergo prior heating. It may be particularly advantageous for the corresponding heating device to be arranged in the secondary circuit within the common flow section or in the contact chamber, and/or between the common flow section and the working chamber, such that the drying air comes into contact with the articles to be dried as soon as possible after said drying air is heated.

A household appliance according to the invention having a primary circuit of a liquid, hygroscopic extraction medium for extracting moisture from drying air and having a secondary circuit of drying air for drying wet articles by means of the drying air is preferably characterized in that the material flows of the primary and secondary circuits are driven by a common actuator.

In the household appliances in question, to improve the drying processes, in each case one primary circuit and one secondary circuit are provided which transport in each case one material mass flow in a closed circuit. For said material transport, drives are required which generate pressure differences in order to effect flows of the respective phases in the circuits.

An advantage of the drying process according to the invention and of the household appliance according to the invention is that the material flows are realized in particular by means of only one actively operated component, and the required common reaction chamber is reduced in size through improved and more intensive dispersal of the phase flows, and can thus be realized at lower cost.

Since the primary and secondary circuits must be merged in a reaction chamber in order to perform absorption and desorption/expulsion, it is the object of the reaction chamber to provide a sufficient dispersal surface area for the interaction processes of a liquid flow and of a gaseous flow. In other words, good Nusselt numbers (heat transfer) and Reynolds numbers (flow/turbulence characteristics) must be realized in order to attain high efficiency of said process.

The secondary circuit is a material flow of moist or dry air which originates from the drying or condensation chamber of the household appliance mentioned in the introduction and which is linked to the subject matter according to the invention.

The subject matter according to the invention furthermore encompasses devices which ensure that liquid constituents of the primary circuit do not pass into the drying chamber or condensation chamber of the household appliance both in the use position of the household appliance and in the non-use position during packaging and shipping.

BRIEF DESCRIPTION OF THE SEVERAL VIEWS OF THE DRAWINGS

Exemplary embodiments of the invention are illustrated in the drawing and will be explained in more detail below, with further details and advantages being specified. In detail.

DETAILED DESCRIPTION OF THE INVENTION

Figure 1:
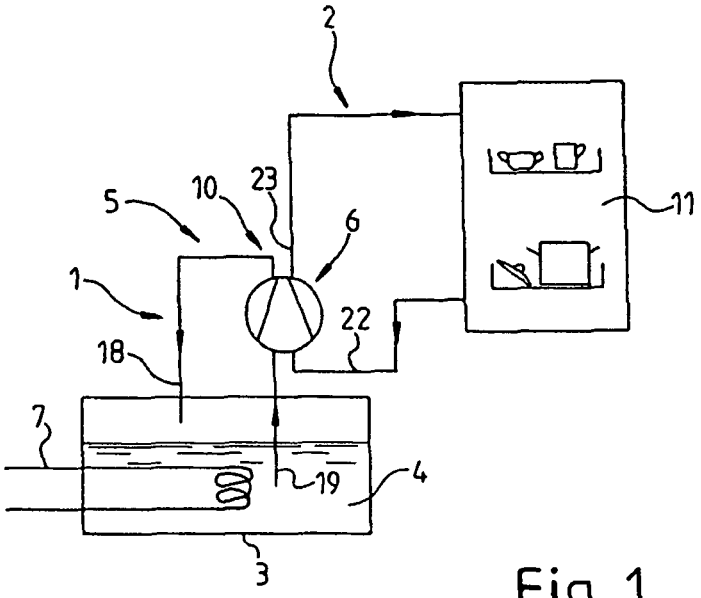
FIG. 1 is a schematic illustration of the primary and secondary circuits in a household appliance having a dispersal element, in the form of a rotor, according to the invention.
Figure 2:
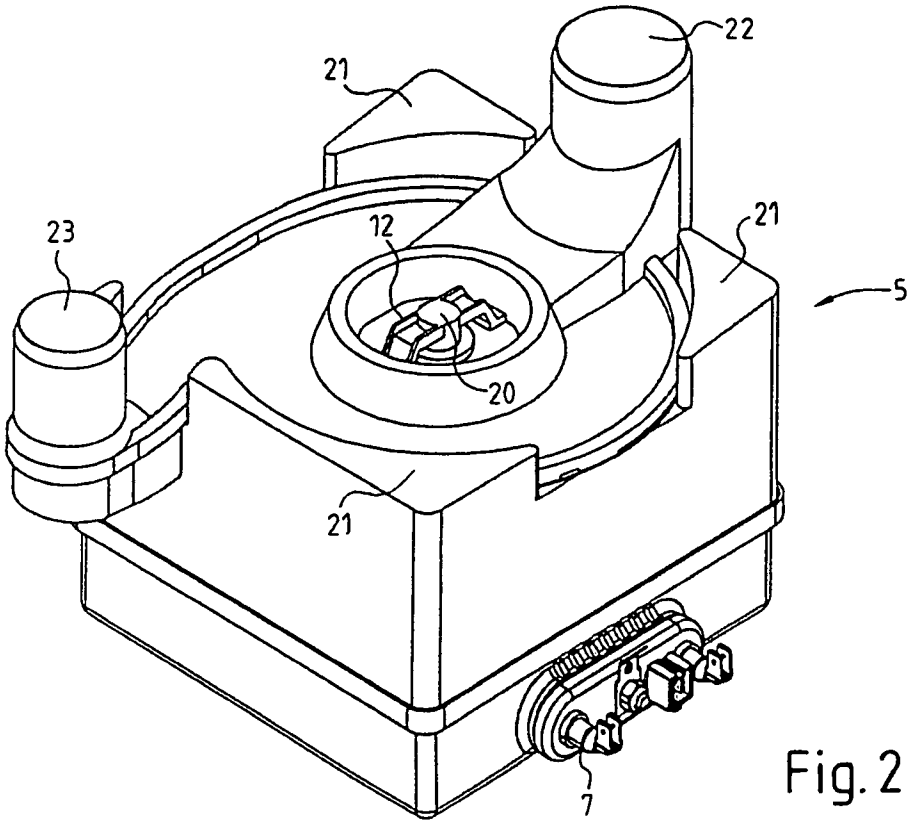
FIG. 2 is a schematic perspective illustration of a compact structural unit having a drive according to the invention.
Figure 3:
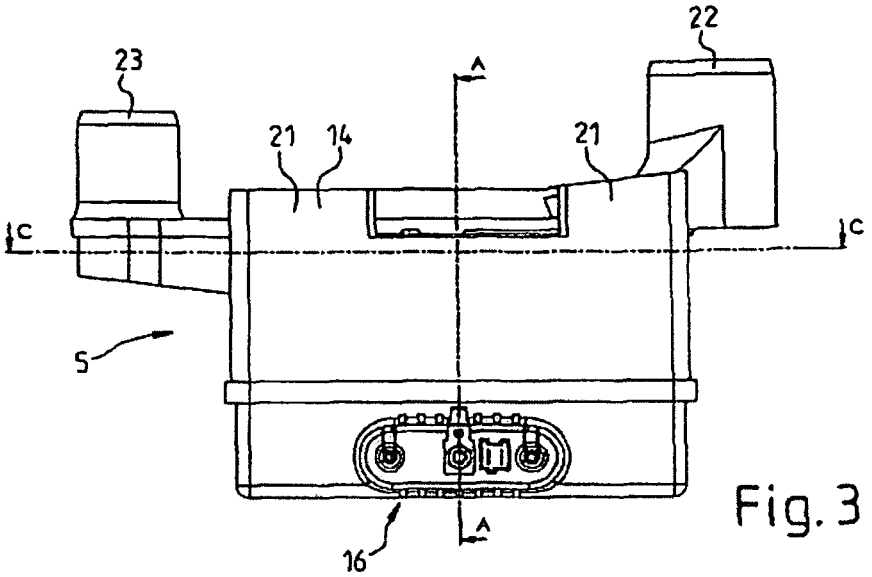
FIG. 3 is a schematic side-on illustration of the compact structural unit as per FIG. 2.
Figure 4:
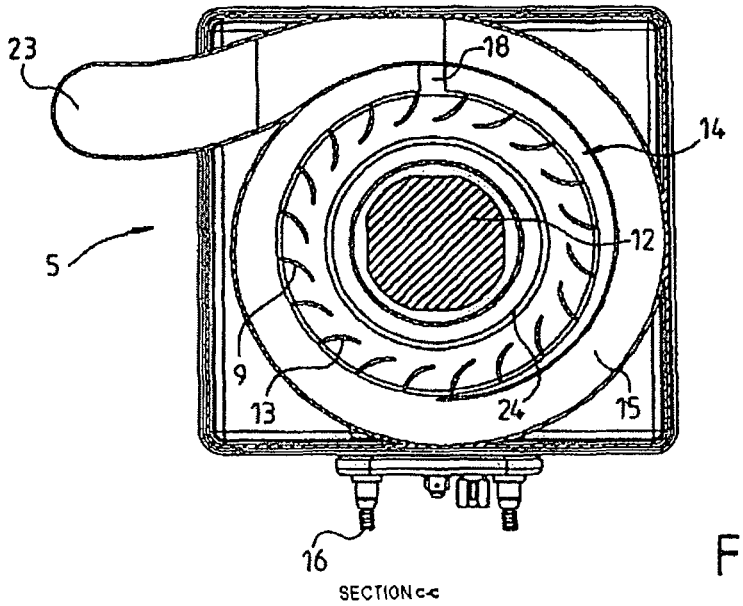
FIG. 4 is a schematic sectional illustration in the region of a fan impeller in a plan view of the compact structural unit as per FIG. 2.

A block circuit diagram of a dishwasher with a drying system is illustrated schematically in FIG. 1. Said drying system comprises a secondary circuit 2, wherein drying air flows out of a working chamber 11 via an inlet 22 to a fan impeller 9 and flows out of a fan housing 14 again in the direction of the working chamber 11 via an outlet 23. Also provided is a primary circuit 1 having a hygroscopic liquid 4 or lithium chloride solution 4 and also having a pump 6. Said pump, by means of a pump impeller 8 or hollow cone wheel 8, pumps the liquid 4 out of a vessel 3 or reservoir 3 to a dispersal element 9.

Furthermore, the pump wheel 8 has radially aligned fins 25 which improve the pumping action. The liquid in the store 17 is hereby more intensely set in rotation, such that the pumping force owing to the centrifugal force is increased. The liquid adheres to the pump wheel 8 and is displaced outward in the radial direction and, owing to the conical or oblique shape of the pump impeller 8, is correspondingly advantageously transported upward and to the dispersal element.

The dispersal element 9 is in the form of a fan impeller 9 and has an electric motor 12 as a drive. Accordingly, the fan impeller 9 rotates about a drive axis 20 of the motor 12, such that the fan 10 or blower 10 can firstly circulate or transport the drying air of the secondary circuit 2. Secondly, the fan impeller 9, by means of its blades 13, can advantageously disperse the liquid which is transported or pumped up to the fan impeller 9 by means of the hollow cone wheel 8. This takes place in that the liquid is very finely dispersed or atomized owing to the centrifugal force acting on the liquid and owing to the turbulence of the drying air within a fan housing 14. In this way, it is possible to generate a particularly large contact surface of the liquid with the drying air, such that the drying is realized particularly efficiently and relatively quickly.

The liquid adheres to the hollow cone wheel 8 and travels along the pump wheel 8 as far as a web 24, at which the liquid detaches or is centrifuged radially outward and is already in part dispersed into droplets and additionally atomized or dispersed by the fan impeller 9. Here, again owing to the turbulent flows in the fan housing, fine dispersal and mixing of the liquid in the drying air are generated, and the drying action is improved.

An annular duct or spiral duct 15 is formed such that the liquid which is centrifuged or accelerated/driven radially outward impinges on walls of the duct 15 and is in part yet more finely dispersed or atomized, the remaining part remaining adhered to and/or flowing down said walls. A liquid film generated here thus also contributes to the drying action as a result of its contact surface with the drying air, and at the same time a separation or division of the liquid from the drying air of the secondary circuit 2 is realized in this way. This is important in order to ensure that as far as possible no liquid escapes from the primary circuit 1 into the secondary circuit 2.

A separate and/or further separation/division of liquid from the drying air may if appropriate take place downstream of the structural unit 5 and/or downstream of the annular duct 15 in order that the retention or recovery of the liquid for/in the primary circuit 1 is optimized or attained as completely as possible. It is for example possible for a labyrinth seal arrangement or the like to be used here.

As a result of the advantageous separation or division of the liquid from the drying air, a virtually closed liquid circuit is generated, such that no retroactive replenishment, or if appropriate only very infrequent replenishment, of the liquid in the primary circuit 1 is necessary. This improves the operation and reduces the outlay for maintenance and servicing during operation.

Furthermore, a regeneration or concentration of the hygroscopic liquid after the absorption of water from the moist drying air is advantageous. A heater 7 or a heating element/heating bar 16 is preferably provided. The heating bar 16 is arranged in the reservoir 17 of the structural unit 5. In this way, the thinned liquid 4 can be regenerated or concentrated again for later/subsequent drying.

It is basically possible in a household appliance according to the preamble of claim 1 for the inlet water to be used for cooling the hygroscopic liquid 4 and/or the reservoir 17. In general, a fluid distributing unit, a so-called diverter, may be provided for the distribution of service water for at least two or preferably three outlets or exits, said fluid distributing unit having a directing element or switch which rotates about an axis of rotation, for example as per document DE 10 2004 040 423. Here, in the washing/sump circuit of the machine, the third outlet may be used for energy management. The two other outlets have hitherto preferably been used for the two spray arms, and the third outlet may inter alia supply water or washing liquid to a consumer and/or to a latent heat accumulator or heat exchanger or the like, or incorporate these into an advantageous energy management system.

Figure 5:
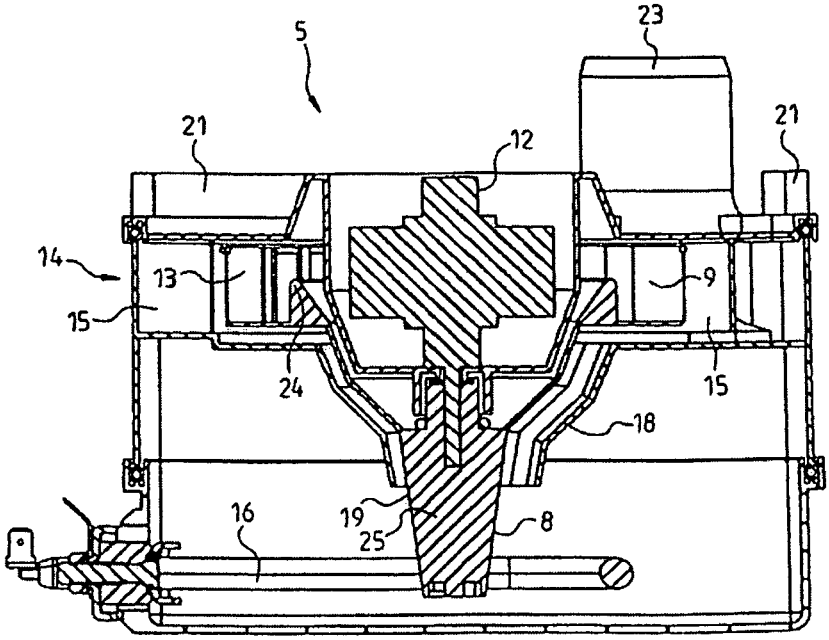
FIG. 5 is a schematic, sectional illustration in the region of the drive axis of the fan impeller in a cross-sectional view of the compact structural unit as per FIG. 2.

Entrances 18 and/or exits 19 of the store 17 are advantageously arranged such that, in the operating position of the structural unit 5 or of the store 17, the exit 19 is arranged in the liquid 4 or below the liquid level. Said liquid can thus advantageously be pumped out by the pump impeller 8. The store 17 is filled with liquid via a supply duct 18 during operation. Here, separated liquid can flow back from the contact chamber or fan housing 14 and/or from a further separation unit after the absorption of water/moisture from the drying air, such that the primary circuit 1 is realized. The duct 18 or the opening 20 thereof is arranged or formed such that, in all tilted positions or angular positions of the structural unit 5, any liquid situated therein flows down/back to the base of the structural unit 5 (that is to say in the direction of the heating bar 16 in the normal operating position), or such that the duct 18 is empty or arranged above the liquid level. The same also applies to the outlet 19, but with the above-described feature that said outlet is arranged below the level in the operating position (as per FIG. 5) in order to be able to discharge liquid. In the advantageous variant of the invention as per FIGS. 2 to 5, the outlet 19 of the accumulator 17 is formed by the hollow cone wheel 8 or pump wheel 8 or the surface thereof.

Furthermore, the structural unit 5 has advantageous cavities 21 or elevations 21 into which, in the tilted position, in particular in the tilted position 180° offset with respect to the normal operating position ("upside down"), liquid can flow and can be stored such that the inlets 18 and/or outlets 19 are situated or arranged above the liquid level.

In the illustrated exemplary embodiment, the exits/entrances 18, 19 are designed so as to empty or drain when the structural unit 5 is in an acute-angled inclined position. If the structural unit 5 is inclined further/to a greater extent, at least the openings of the exits/entrances are arranged above the liquid level.

It is generally advantageous if/that the store 17 has a store volume larger than a resting volume of the liquid, that is to say at rest or when the primary circuit 1 is out of operation. During operation, the liquid volume within the store 17 is smaller than the resting volume, because for the drying process, liquid adheres to the pump wheel 8 and is situated in the fan housing 14 or in the contact chamber.

The accumulator 17 is thus larger, by a differential volume, than the resting volume of the liquid 4, such that said differential volume above the liquid level is filled with gas/air. Said differential volume is of such a size that, in the inclined position, the outlets/inlets 18, 19 are situated above the level. In this way, for example during transportation of the structural unit 5 or of the household appliance, a situation cannot arise in which liquid 4 is inadvertently lost and must be replaced or replenished. This improves operational reliability and has the effect that for example the structural unit 5 is produced separately and first installed during the assembly of the household appliance according to the invention, without liquid being able to escape. If appropriate, the structural unit 5 must be placed transversely during assembly owing to restricted spatial conditions of the already partially assembled household appliance. Nevertheless, as a result of the abovementioned advantageous measures, no liquid escapes. All of this has the effect that the hygroscopic liquid 4 can be fully installed and if appropriate checked independently of the assembly or the transportation of the rest of the appliance/the appliance as a whole, and it is ensured that said hygroscopic liquid is not at too low a level after assembly and during operation. This improves the operational reliability and in particular also the warranty of the structural unit 5 according to the invention.

In one advantageous embodiment of the subject matter of the invention, a common mixing/reaction chamber or contact chamber of the primary and secondary circuits is realized. Said chamber is composed for example of a housing as a liquid sump, which contains, in terms of a balance volume, the liquid volume of the extraction medium. The fill quantity corresponds at least to the lower balance volume. The vessel is furthermore composed of a fan cover, a fan housing. The fan housing bears, at the exit, a spiral fin. The secondary circuit is however connected to the fan suction side of the housing cover and to the pressure port of the fan housing. The vessel furthermore bears the motor which drives the rotor and the pump hollow cone which is connected to the rotor. The pump hollow cone bears, on the inside, hollow cone guide fins which, via the pump hollow cone inlet and via the pump annular gap, conduct the liquid extraction medium via the rotor blade internal fin to the pump mixing fan impeller. Via the liquid return line, the liquid return line is supplied from the fan housing and the connected fan pressure port to the liquid sump.

At the rotor, therefore, the pumped liquid two-substance mixture is merged and placed in intimate mass-transfer contact with the gas flow passing via the fan suction side, and is transported to the fan pressure port. Transported liquid constituents are recirculated via the spiral housing and possibly via a droplet separator connected downstream of the fan pressure port. The gap dimension between the pump hollow cone and the conical projection of the radial fan housing prevents the escape of the liquid quantity present in the liquid sump in the event that the usage position of the appliance departs from the vertical working position illustrated here. It must be taken into consideration here that the upper balance volume of the sump constitutes a greater volume than the lower balance volume, which corresponds to the nominal fill quantity, of the sump.

It is also conceivable to realize a transportation of liquid in the gap between the hollow cone and conical projection of the fan housing with a simple external fin arrangement on the hollow cone.

For absorption operation, the moist air from the drying chamber is supplied from the household appliance via the fan suction side and is supplied as substantially dry air back to the drying chamber via the fan pressure port.

In the case of desorption/expulsion, the liquid quantity present in the liquid sump is directly or indirectly heated. The moist air generated is connected via the fan pressure port to the condensation chamber of the household appliance and supplied from here again as dry air via the fan suction side.

LIST OF REFERENCE NUMERALS

1 Primary circuit
2 Secondary circuit
3 Vessel
4 Lithium chloride solution (LiCl aq.)
5 Structural unit
6 Pump
7 Heater
8 Hollow cone or pump impeller
9 Fan impeller or dispersal element
10 Fan
11 Working chamber
12 Motor
13 Blade
14 Housing
15 Duct
16 Heating bar
17 Store
18 Entrance
19 Exit
20 Axis
21 Cavity
22 Inlet
23 Outlet
24 Web
25 Rib

What is claimed is:

1. A household appliance having a primary circuit with a hygroscopic liquid for extracting moisture from drying air, and a secondary circuit for drying wet articles by the drying air, wherein the improvement comprises a contact chamber having an interior space with a fan connected to the secondary circuit and at least one dispersal element to disperse the hygroscopic liquid into the secondary circuit for drying the air and provide a surface area enlargement for the hygroscopic liquid and at least one drive for imparting drive and/or movement, to both the fan and the at least one dispersal element to allow the hygroscopic liquid to be dispersed with kinetic drive energy.

2. The household appliance according to claim 1, wherein the dispersal element is movable in the contact chamber and wherein the surface area enlargement of the hygroscopic liquid is achieved by means of the transfer of kinetic drive energy by the movement of the dispersal element.

3. The household appliance according to claim 1 wherein the dispersal element of the contact chamber is a dispersal nozzle and has at least one drive for driving and/or pressurizing the hygroscopic liquid to disperse the hygroscopic liquid with kinetic drive energy.

4. The household appliance of claim 3 further comprising a pump having at least one hollow truncated cone as a feed element to feed Lhe hygroscopic liquid to the dispersal element.

5. The household appliance according to claim 1 wherein the at least one drive is a fan motor disposed in the secondary circuit.

6. The household appliance according to claim 1 wherein the at least one dispersal element is a fan impeller of the fan.

7. The household appliance according to claim 1 wherein the at least one drive is a pump motor for pumping the hygroscopic liquid in the primary circuit.

8. The household appliance according to claim 1 further comprising a pump having at least one hollow truncated cone as a feed element to feed the hygroscopic liquid to the dispersal element.

9. The household appliance according to claim 1 further comprising at least one separating unit for separating the hygroscopic liquid from the drying air disposed downstream of the dispersal element in the flow direction of the drying air.

10. The household appliance according to claim 9 wherein the separating unit has at least one spiral duct.

11. The household appliance according to claim 9 wherein the separating unit is a labyrinth seal.

12. The household appliance according to claim 1 wherein the hygroscopic liquid is a brine solution.

13. The household appliance of claim 1 wherein the household appliance is a dishwasher or a tumble drier.

* * * * *